United States Patent [19]

Klarstrom

[11] Patent Number: 4,476,091

[45] Date of Patent: Oct. 9, 1984

[54] OXIDATION-RESISTANT NICKEL ALLOY

[75] Inventor: Dwaine L. Klarstrom, Kokomo, Ind.

[73] Assignee: Cabot Corporation, Kokomo, Ind.

[21] Appl. No.: 353,459

[22] Filed: Mar. 1, 1982

[51] Int. Cl.[3] ..... C22C 19/05

[52] U.S. Cl. ..... 420/443; 420/584; 420/585; 420/588

[58] Field of Search ..... 420/443, 452, 453, 454, 420/455, 584, 585, 586, 588; 148/410, 419, 427, 428, 442

[56] References Cited

U.S. PATENT DOCUMENTS 4,110,110 8/1978 Kondo et al. ..... 420/452

*Primary Examiner*—R. Dean

*Attorney, Agent, or Firm*—Jack Schuman; Joseph J. Phillips

[57] ABSTRACT

Disclosed is an oxidation resilient nickel alloy containing chromium, tungsten and molybdenum in a critical relationship that provides a combination of engineering properties including a high degree of dynamic oxidation resistance and superior strength.

The alloy is especially suited for service under severe conditions, for example, as components of gas turbine engines.

5 Claims, 5 Drawing Figures

Figure 1. Dynamic Oxidation Test 1800°F/500 hours - Weight Loss Data

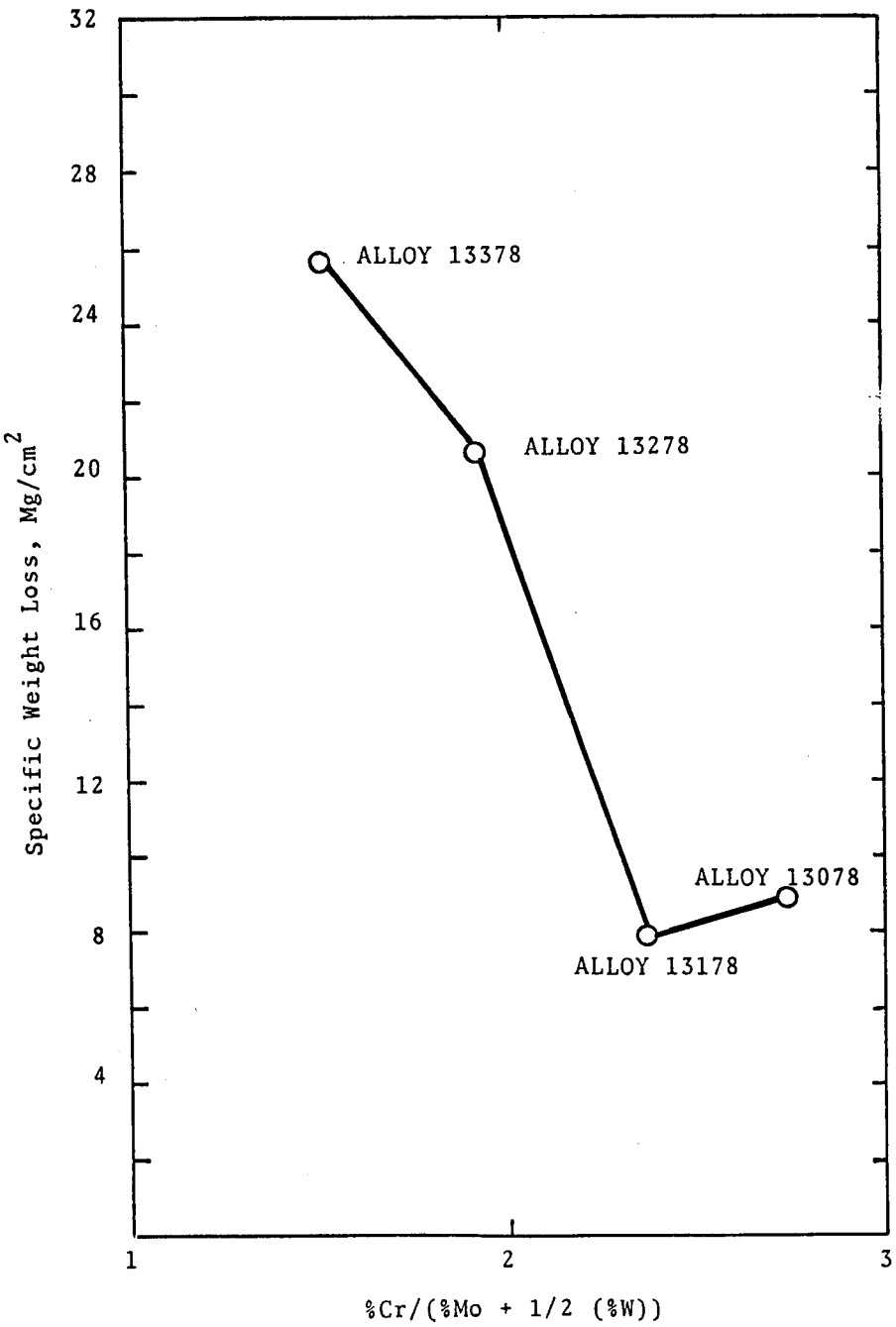
Figure 1. Dynamic Oxidation Test
1800°F/500 hours - Weight Loss Data

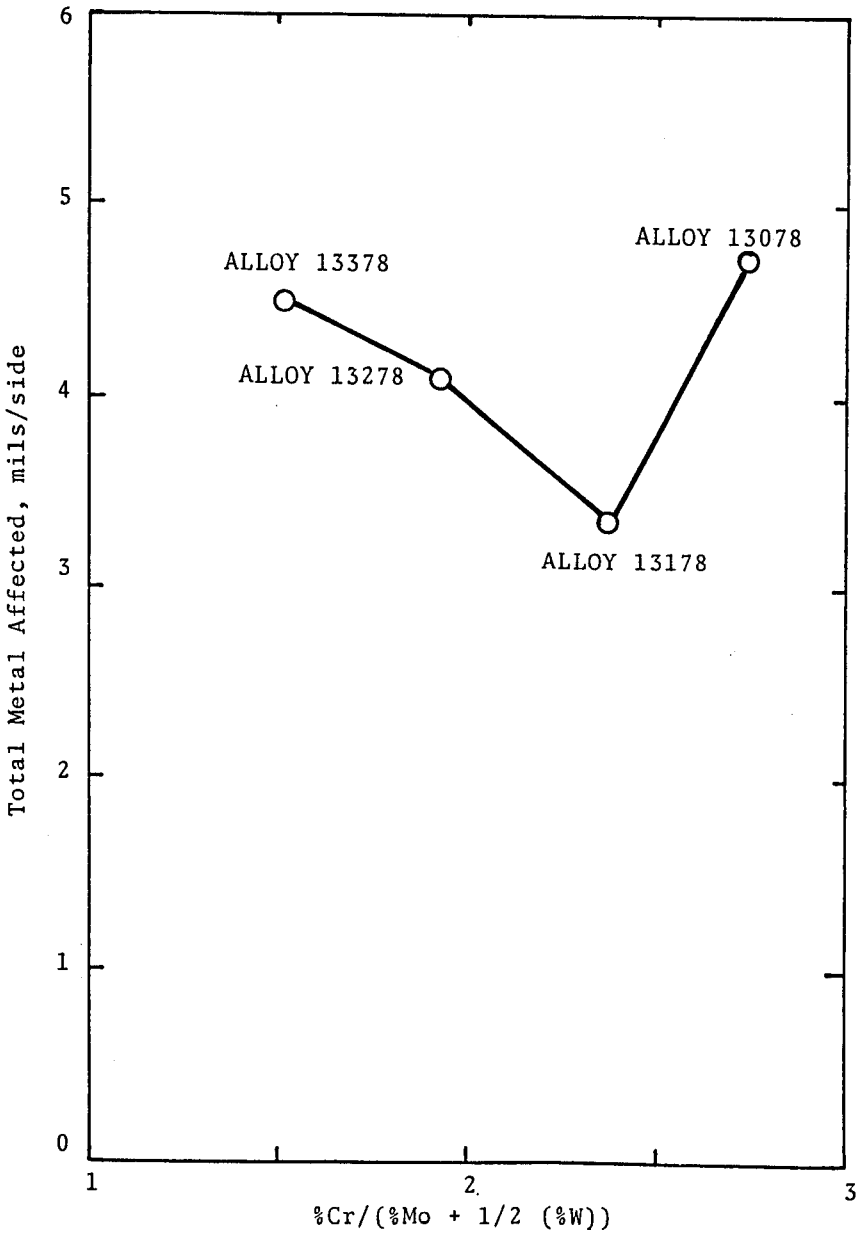
Figure 2. Dynamic Oxidation Test
1800°F/500 hours - Depth of metal affected data

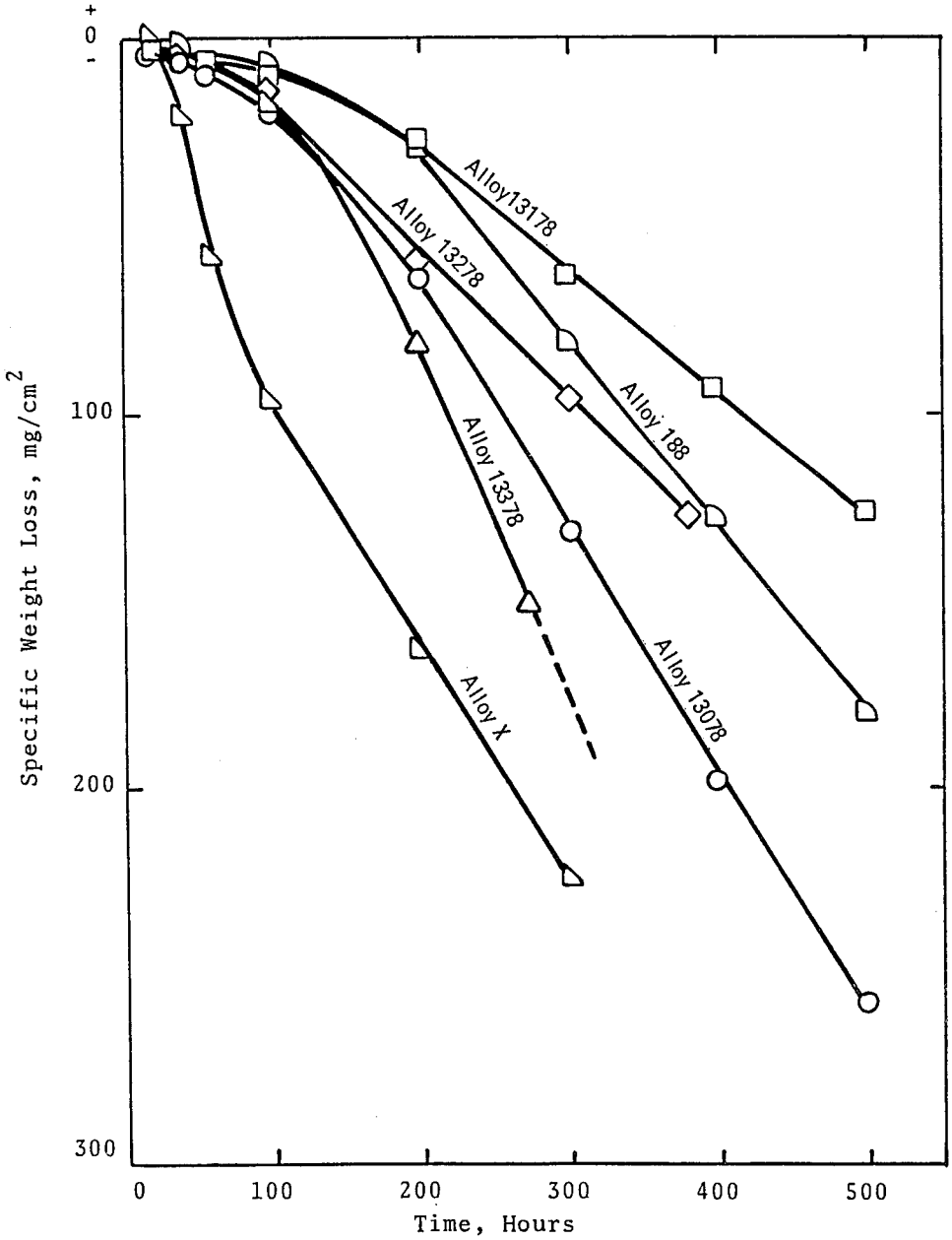
Figure 3. 2000°F for times to 500 hours - Weight Loss Data

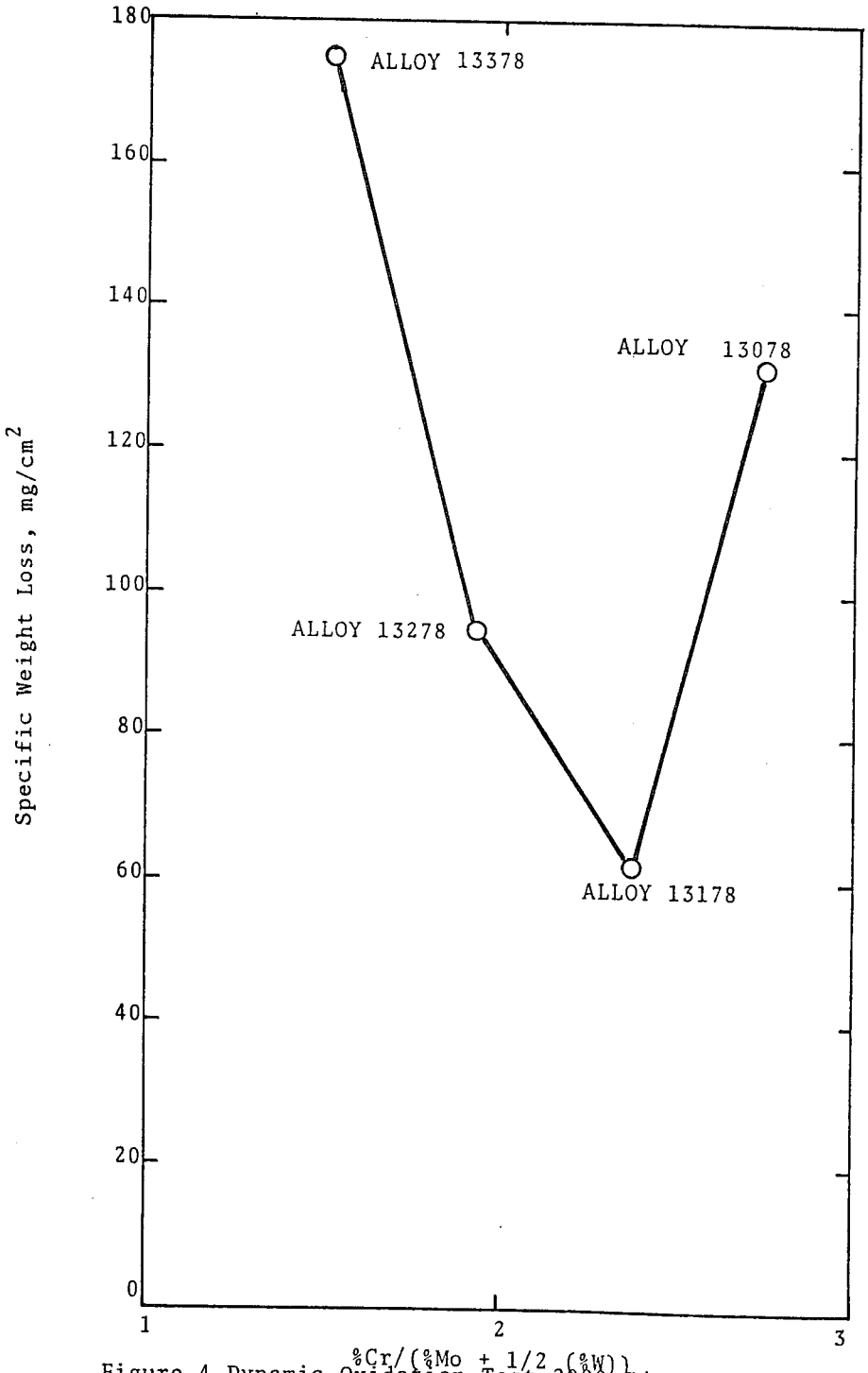
Figure 4. Dynamic Oxidation Test-2000 F/300 hrs. Weight Loss Data

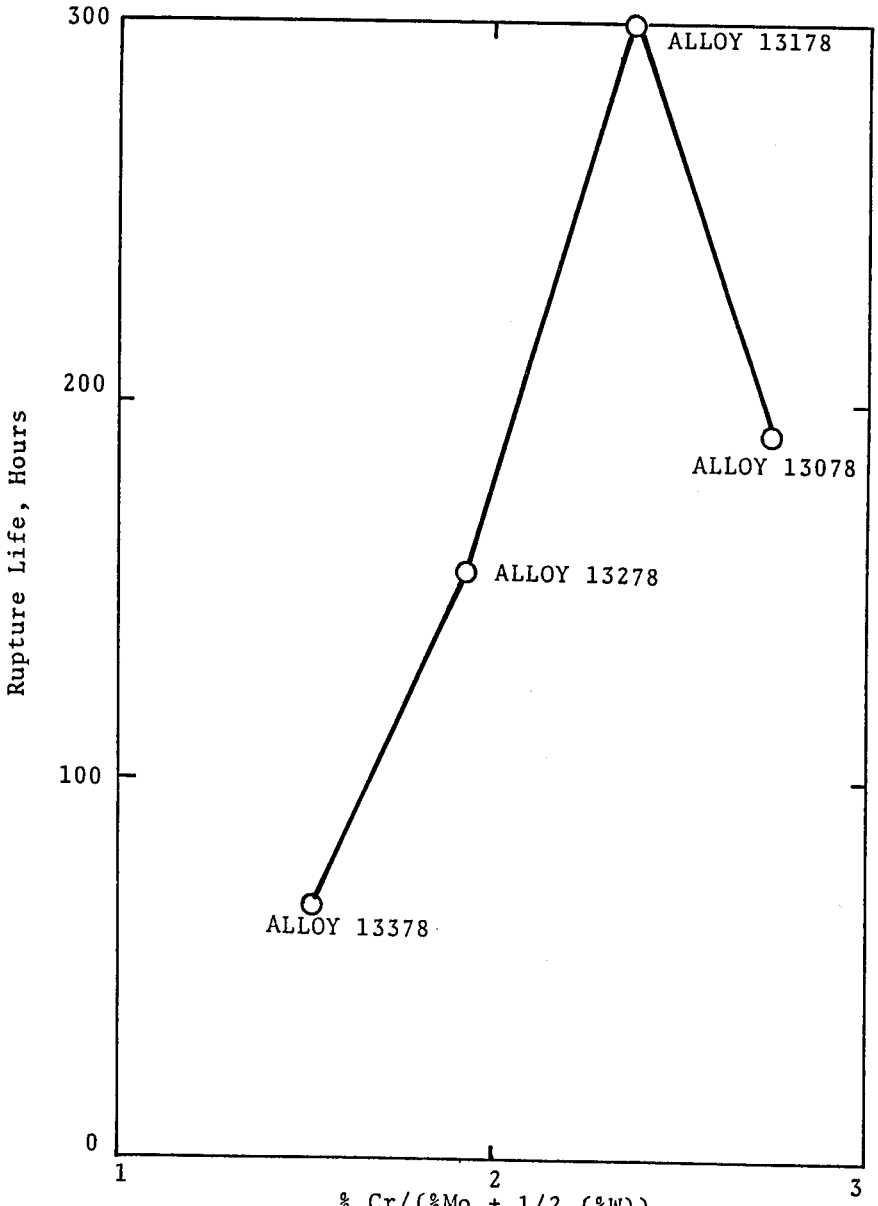
Figure 5. Stress-Rupture Test (1800°F at 4000 lb load) - Life in Hours

OXIDATION-RESISTANT NICKEL ALLOY

This invention relates to nickel base alloys for use in severe conditions of oxidation and high temperatures, and more specifically, to nickel base alloys containing chromium, tungsten and molybdenum as principal elements for optimum oxidation and engineering properties.

BACKGROUND

Nickel base superalloys have been developed for use in severe service conditions including corrosion, high temperature and mechanical operations. Typical examples include a group of recent patented alloys as defined in U.S. Pat. Nos. 3,865,581, 4,006,015, 4,110,110 and 4,194,909. Compositions of these alloys are shown in Table 1. Table 1 lists the broadest ranges of all elements required or optional as disclosed. The alloys appear to be closely related in compositions. The compositional variations among these alloys, although seemingly minor, are effective to the extent that each of the alloys is a distinctive alloy with physical and mechanical properties especially suited for a particular use. This situation is generally common in metallurgy and especially in the superalloy arts.

PRIOR ART

U.S. Pat. No. 3,865,581 is especially suited for use at high temperature and where torsional strength is required. The alloy depends upon the relationship among boron, magnesium, beryllium and especially, critical contents of zirconium and cerium for optimum results.

U.S. Pat. No. 4,006,015 is especially suited for use at high temperature under conditions requiring good creep-rupture properties. The alloy contains critical proportions of nickel, chromium, tungsten and titanium.

U.S. Pat. No. 4,110,110 is especially suited for use in nuclear applications in low oxidizing atmospheres, for example, argon or vacuum. The effective properties are obtained by proper contents of chromium, manganese and silicon with critical limitations of titanium and aluminum.

U.S. Pat. No. 4,194,909 is especially designed for use in gas cooled reactors. The desired properties (including creep rupture) are obtained by the critical control of calcium, magnesium, zirconium, niobium, hafnium and a rare earth metal. Further, the alloy must not contain cobalt and titanium.

The patents appear to disclose a particular group of related alloys. The basic compositions appear to be generally similar.

These patents, in general, teach the critical content of one or more minor elements, inter alia, to achieve optimum results. The teachings vary, for example, while one patent teaches a low aluminum content, another discloses a higher aluminum content as critical. This suggests the "art and science" of this class of alloys is not established and needs additional improvements.

OBJECTS OF THIS INVENTION

It is the principal object of this invention to provide a novel alloy with improvements in a combination of good engineering properties.

It is another object of this invention to provide an alloy with a high degree of oxidation resistance and high strength in prolonged elevated temperature environments. Other aims and objectives will become apparent to those skilled in the art in view of subsequent disclosures.

SUMMARY OF THE INVENTION

These and other objects and advantages are obtained by the provision of the alloy of this invention as described in Table 2. Contrary to the commonly accepted notion that tungsten and molybdenum are often interchangeable totally or in part, the alloy of this invention requires both tungsten and molybdenum must always be present, within the ranges shown in Table 2 and in critical proportions. Tungsten must always exceed molybdenum by a ratio at least about 4.5 to 1, respectively, within the ranges given in Table 2. Furthermore, in the alloy of this invention, the contents of chromium, tungsten and molybdenum must be present in the critical relationship:

$$\frac{Cr}{Mo + \frac{1}{2}W} = \text{about } 2.05 \text{ to } 2.65$$

where

Cr = percent chromium by weight,

Mo = percent molybdenum by weight,

W = percent tungsten by weight.

W:Mo ratio should be about 7:1 and the $$\frac{Cr}{Mo + \frac{1}{2}W}$$

ratio should be within the range 2.2 to 2.6 for optimum benefits of this invention.

It was discovered, as a critical feature of this invention, the control of the electron vacancy (Nv) number is essential to obtain the objectives of this invention. The method of determining the electron vacancy number is discussed in *The Journal of Metals* October, 1966, by C. T. Sims and U.S. Pat. No. 4,118,223.

For the purposes of this invention, it was found that the formation of desirable intermetallic precipitates can be avoided by controlling a balanced composition for which the Nv has a value of not over 2.5 and preferably less than about 2.4. The Nv numbers for the experimental alloys are shown in Table 2.

Balancing the composition of the alloy to obtain the lowest Nv number imposes an additional limitation and burden in the production of the alloy of this invention. Nevertheless, it is essential to maintain a very low Nv number to obtain the full benefits of this invention.

Although the exact mechanism of the science of the invention is not completely understood, it is believed that the critical amount and ratio of chromium, tungsten and molybdenum act in a synergistic manner to provide the valuable combination of oxidation resistance and strength. These elements appear to be present in a crucial proportion of carbide formers and in solid solution. Because of this crucial proportion in the microstructure, the alloy of this invention resists dynamic oxidation losses and has a high degree of stress rupture life.

Iron, cobalt, columbium, tantalum, vanadium, zirconium, and the like are tolerable in the alloy as adventitious elements as may be found in alloys of this class. Aluminum may also be present as a result of processing, i.e. deoxidation and adequate control of lanthanum. A content of up to about 0.50% aluminum may be present.

BRIEF DESCRIPTION OF THE DRAWINGS

FIGS. 1, 2, 3 and 4 represent dynamic oxidation test results at various temperatures of experimental alloys.

FIG. 5, represents "stress rupture life" data of experimental alloys.

EXAMPLES

To verify the advantages of the novel alloy, a series of alloys as described in Table 3 was produced. The alloys contained adventitious contents of cobalt, aluminum, iron, and other elements normally found in alloys of this class. The entire composition range of the four alloys was relatively narrow. Test results of these alloys reveal an unexpected result. Within the already narrow range of composition, a critical ratio $$\frac{Cr}{Mo + \frac{1}{2}W}$$

was discovered to provide an outstanding combination of valuable properties. Thus, this invention resides in the provision of an alloy with a narrow composition range and a required ratio among chromium, tungsten and molybdenum. Alloy 13178 is the alloy representative of this invention. Subsequent data and discussion will show Alloy 13178 to be superior over the other experimental alloys and that such superiority is totally unexpected. The values of $$\frac{Cr}{Mo + \frac{1}{2}W}$$

for the four experimental alloys range from 1.52 to 2.74, while the content of all other elements remain relatively constant. Subsequent data will be presented that shows the variation of properties in terms of the $$\frac{Cr}{Mo + \frac{1}{2}W}$$

ratio values. The data show, in every case, the best combination of properties is obtained at the ratio value of about 2.2 to about 2.6. This is unexpected. It would be expected that, since all elements are relatively constant, the best alloy should be the one with the highest or lowest ratio value.

The alloys were prepared by vacuum induction melting (VIM) the electro-slag remelting (ESR) to refine the composition.

Each heat was prepared as a 4-inch ingot then hot forged to 1-inch stock. Following an anneal at 2150° F., the heats were hot rolled to 178 -inch thick stock at 2150° F. The heats were then cold rolled to 0.1-inch, annealed at 2150° F., and cold rolled down to 0.05 inch. The final anneal temperature was 2250° F. followed by rapid cooling.

Because the melting of the alloy of this invention was relatively trouble-free, it is expected that the alloy may be produced by most well-known processes. Furthermore, because the casting and working characteristics of the alloy of this invention are relatively trouble-free, the alloy may be produced in a great variety of commercial forms including castings, wires, powders, welding and hardfacing products and the like.

TEST RESULTS

Test samples of the four experimental alloys were tested under very severe oxidation conditions. The well-known dynamic oxidation test procedure was used as follows:

1. Prepare specimens about $1/16 \times \frac{3}{8} \times 3$ inches.
2. Grind all surfaces to a 120-grit finish and degrease in a solvent such as acetone.
3. Measure exact surface area and weight of each specimen.
4. Expose specimens in a holder rotating at 30 RPM to the combustion products of an oil fired flame plus excess air moving at a velocity of about 0.3 Mach.
5. Cool to near ambient temperature each 30 minutes.
6. Weigh each sample after every 25-hours of the test for the duration of the tests.
7. Section each sample at a point 2-inches from the base, mount for metallographic examination and optionally measure depth of continuous penetration, depth of internal oxidation and unaffected thickness.
8. Calculate average weight loss ($mg/cm^2$).
9. Calculate total depth of affected metal.

FIG. 1 is a graphic presentation of the metal weight loss data obtained in the dynamic oxidation test at 1800° F. for 500 hours.

FIG. 2 is a graphic presentation of the depth of affected metal data obtained in the dynamic oxidation test at 1800° F. for 500 hours.

FIG. 3 is a graphic presentation of the metal weight loss data obtained in the dynamic oxidation test at 2000° F. for times up to 500 hours. FIG. 3 also contains data obtained for two well-known commercial alloys: Alloy 188 and Alloy X. Alloy 188 is cobalt-base containing 22% chromium, 22% nickel, 14.5% tungsten, 0.07% lanthanum. Alloy X is nickel-base containing 22% chromium, 9% molybdenum and 18.5% iron.

FIG. 4 is a graphic presentation of the metal weight loss data obtained in the dynamic oxidation test at 2000° F. for 300 hours.

FIG. 5 is a graphic presentation of the stress-rupture life data obtained by the standard well-known "Stress Rupture Test". Data are presented for tests at 1800° F. and 4000 psi load.

The data clearly show that both (1) alloys with higher ratio values and (2) alloys with lower ratio values are inferior to the alloy of this invention, which has a ratio value of 2.37. The test data suggest that the value of $$\frac{Cr}{Mo + \frac{1}{2}W}$$

may vary from about 2.2 to about 2.6 and yet retain the benefits of this invention. This range may be expected during the commercial production of alloys of this class. It is not practical to expect to get exact aim points in every production heat. A reasonable range must be expected. For this reason, the broad and preferred composition ranges of the alloy of this invention are suggested.

TABLE 1

SELECTED PATENTED NICKEL BASE ALLOYS
Compositions, in weight percent

| | U.S. Pat. No. 3,865,581 | U.S. Pat. No. 4,006,015 | U.S. Pat. No. 4,110,110 | U.S. Pat. No. 4,194,909 |
|---|---|---|---|---|
| Al | 0.5–10.0 | 0.1–1.0 | .001–.2 | .1–1.0 |
| B | .0005–.2 | .001–.05 | .001–.05 | — |
| Be | .001–1.0 | — | — | — |
| C | .01–.5 | .001–.1 | .04–.25 | .04–.25 |

TABLE 1-continued

| SELECTED PATENTED NICKEL BASE ALLOYS Compositions, in weight percent | U.S. Pat. No. 3,865,581 | U.S. Pat. No. 4,006,015 | U.S. Pat. No. 4,110,110 | U.S. Pat. No. 4,194,909 |
|---|---|---|---|---|
| Ca | — | — | .001–.05 | .005–.05 |
| Cb | .05–10 | .05–.7 | — | .01–3.0 |
| Co | .1–30 | Nil | .05–30 | Nil |
| Cr | 10–40 | 18–25 | 10–25 | 10–25 |
| Cu | .05–10 | — | — | — |
| Fe | Bal | 1 max | .1–30 | — |
| Hf | — | .01–.5 | — | .1–1.5 |
| La | — | — | — | — |
| Mg | .001–.2 | .001–.05 | .001–.02 | .001–.02 |
| Mn | .01–3.0 | .5 max | .4–1.5 | — |
| Mo | .1–10 | Nil | .1–10 | — |
| Si | .01–2.0 | .5 max | .05–.5 | — |
| Ta | .05–10 | — | — | — |
| Ti | .05–10.0 | .05–.7 | .001–.05 | Nil |
| V | .05–10 | — | — | — |
| W | .1–10 | 16–22 | .1–25 | 10–25 |
| Y | .05–10 | .005–.2 | — | — |
| Zr | .001–6.0 | .01–.12 | .01–.1 | .005–.1 |
| R/E* | .001–.5 | — | .001–.02 | .001–.02 |
| Ni + Impurities | 22–80 | Bal | Bal | Bal |

*R/E — Rare earths metals

TABLE 2

| ALLOY OF THIS INVENTION Composition, weight percent | Broad Range | Preferred Range | Typical Alloy |
|---|---|---|---|
| Al | .50 max | .50 max | .50 max |
| B | .02 max | .001–.015 | about .01 |
| C | .05–.15 | .05–.15 | about .10 |
| Cb | .2 max | .2 max | .2 max |
| Co | 5 max | 3 max | 3 max |
| Cr | 20–24 | 20–24 | about 22 |
| Fe | 5 max | 3 max | 3 max |
| La | Trace–.05 | .005–.05 | about .02 |
| Mn | .3–1.0 | .3–1.0 | about .50 |
| Mo | 1.0–3.5 | 1–3 | about 2.0 |
| P | .03 max | .02 max | .02 max |
| S | .015 max | .008 max | .008 max |
| Si | .20–.75 | .20–.60 | about .40 |
| Ta | .2 max | .2 max | .2 max |
| Ti | .2 max | .2 max | .2 max |
| V | .2 max | .2 max | .2 max |
| W | 10–20 | 13–15 | about 14 |
| Zr | .2 max | .2 max | .2 max |
| Ni | Bal* | Bal* | Bal* |
| W:Mo | 4.5 to 12:1 | 5:1 to 10:1 | about 7:1 |
| $\frac{Cr}{Mo + \frac{1}{2}W}$ | 2.05–2.65 | 2.2–2.6 | about 2.4 |

*Nickel plus impurities

TABLE 3

| ELEMENT | EXPERIMENTAL ALLOYS 13078 | 13178 | 13278 | 13378 |
|---|---|---|---|---|
| Al | .05 | .06 | .05 | .04 |
| B | .003 | .006 | .006 | .006 |

TABLE 3-continued

| ELEMENT | EXPERIMENTAL ALLOYS 13078 | 13178 | 13278 | 13378 |
|---|---|---|---|---|
| C | .16 | .10 | .09 | .11 |
| Cr | 21.13 | 21.40 | 20.14 | 18.00 |
| La | .019 | .021 | .021 | .028 |
| Mn | .40 | .42 | .41 | .41 |
| Mo | Trace | 2.00 | 3.04 | 4.04 |
| Si | .28 | .23 | .19 | .22 |
| W | 15.44 | 14.08 | 14.83 | 15.66 |
| $\frac{Cr}{Mo + \frac{1}{2}W}$ | 2.74 | 2.37 | 1.93 | 1.52 |
| W:Mo | +100 | 7.04 | 4.88 | 3.88 |
| Nv number | 2.19 | 2.27 | 2.31 | 2.32 |

*Balance nickel plus impurities

What is claimed is:

1. An alloy consisting essentially of, in weight percent, aluminum up to 0.5, boron up to 0.02, carbon 0.05 to 0.15, cobalt up to 5, chromium 20 to 24, iron up to 5, lanthanum 0.005 to 0.05, manganese 0.3 to 1.0, molybdenum 1 to 3.5, phosphorus up to 0.03, sulfur up to 0.015, silicon 0.2 to 0.75, tungsten 10 to 20, the combined content of columbium, tantalum, titanium, vanadium and zirconium up to 1.0 total, and the balance nickel plus impurities, provided that the value of $$\frac{Cr}{Mo + \frac{1}{2}W}$$

is within the range of 2.2 to 2.6, the tungsten to molybdenum ratio is between 4.5 to 1 and 12 to 1, and the Nv number is less than about 2.5 wherein said value and said ratio are controlled to yield a high degree of oxidation resistance and high strength.

2. The alloy of claim 1 wherein the boron is 0.001 to 0.015, the cobalt and iron are each up to 3, the molybdenum is 1 to 3, the phosphorous is up to 0.02, the sulfur is up to 0.008, the silicon is 0.2 to 0.6, the tungsten is 13 to 15, and the ratio of tungsten to molybdenum is between 5:1 and 10:1.

3. The alloy of claim 1 wherein the boron about 0.01, the carbon about 0.10, the chromium about 22, the cobalt and iron each about 3, the lanthanum about 0.02, the manganese about 0.50, the molybdenum about 2, the silicon about 0.40, and the tungsten about 14.

4. The alloy of claim 1 wherein the boron is about 0.006, the carbon is about 0.10, the chromium is about 21.4, the lanthanum is about 0.021, the manganese is about 0.42, the molybdenum is about 2.0, the silicon is about 0.23, the tungsten is about 14, the value of $$\frac{Cr}{Mo + \frac{1}{2}W}$$

is about 2.4, the tungsten to molybdenum ratio is about 7 to 1 and the Nv number is less than about 2.4.

5. The alloy of claim 1 in the form of an article for use as a gas turbine engine component requiring a high degree of oxidation resistance and high strength.

* * * * *

UNITED STATES PATENT AND TRADEMARK OFFICE

CERTIFICATE OF CORRECTION

PATENT NO. : 4,476,091

DATED : October 9, 1984

INVENTOR(S) : Dwaine L. Klarstrom

It is certified that error appears in the above-identified patent and that said Letters Patent is hereby corrected as shown below:

column 2, line 42, after formation of,word "desirable" should read --undesirable--. Column 3, line 48, after (VIM), word "the" should read --then--. Column 3, line 52, number "178" should read --1/2--.

Signed and Sealed this

*Twenty-fourth* Day of *September 1985*

[SEAL]

*Attest:*

*Attesting Officer*

DONALD J. QUIGG

*Commissioner of Patents and Trademarks—Designate*